US005455379A

United States Patent [19]

Kim et al.

[11] Patent Number: 5,455,379

[45] Date of Patent: Oct. 3, 1995

[54] ADAPTIVE CHORD GENERATING APPARATUS AND THE METHOD THEREOF

[75] Inventors: Jae H. Kim; Byung S. Yoo, both of Seoul, Rep. of Korea

[73] Assignee: Gold Star Co., Ltd., Seoul, Rep. of Korea

[21] Appl. No.: 976,756

[22] Filed: Nov. 16, 1992

[30] Foreign Application Priority Data

Nov. 15, 1991 [KR] Rep. of Korea ..... 91-20306

[51] Int. Cl.[6] ..... G10H 1/38

[52] U.S. Cl. ..... 84/637; 84/DIG. 22

[58] Field of Search ..... 84/613, 637, DIG. 22

[56] References Cited

U.S. PATENT DOCUMENTS

| | | | |
|---|---|---|---|
| 4,467,689 | 8/1984 | Stier et al. | 84/DIG. 22 |
| 4,905,561 | 3/1990 | Mizuno . | |
| 5,014,586 | 5/1991 | Sakashita | 84/637 |
| 5,088,380 | 2/1992 | Minamitaka | 84/637 |
| 5,136,914 | 8/1992 | Letts et al. | 84/637 X |
| 5,260,510 | 11/1993 | Shibukawa | 84/637 |

FOREIGN PATENT DOCUMENTS

| | | |
|---|---|---|
| 1603680 | 5/1978 | United Kingdom . |
| 2209425 | 5/1989 | United Kingdom . |

*Primary Examiner*—Stanley J. Witkowski
*Attorney, Agent, or Firm*—Pennie & Edmonds

[57] ABSTRACT

An adaptive chord-generating apparatus and method exactly generates chord data specified by a performer by an operation method according to the number of constituent notes of a chord inputted by a performer. To do this, the apparatus and method comprises a keyboard for receiving constituent notes of chord and melody, a memory where a chord search table is stored, a control portion for searching a chord search table of the memory according to a rule corresponding to the number of constituent notes inputted from the keyboard and generating chord data having a chord type and a pitch based on the searched data, and a sound source generator for generating a musical instrument sound signal having a predetermined pitch of chord corresponding to chord data supplied from the control portion.

8 Claims, 10 Drawing Sheets

| CHORD TYPE | WEIGHT VALUE | LABEL |
|---|---|---|
| MAJOR | 1 | MAJ |
| MINOR | 2 | MIN |
| DOMINANT 7TH | 3 | DON |
| MINOR 7TH | 4 | MI7 |
| AUGMENTED | 5 | AUG |
| DIMINISHED | 6 | DIM |
| SUSPENDED 4TH | 7 | SUS |
| MAJOR 7TH | 8 | MAJ7 |
| MINOR 7TH FLATTENED 5TH | 9 | MI7b5 |
| DOMINANT 7TH SUSPENDED 4TH | 10 | DOM7SUS |

FIG.9

| | | | | | |
|---|---|---|---|---|---|
| MAJ + 00h<br>DOM + 80h | MAJ7 + 00h<br>MAJ + 00h | DOM + 20h<br>MAJ + 80h | MIN + 00h<br>MIN + 90h | MAJ + 00h<br>DOM + 00h | MAJ + 50h<br>MAJ7 + 10h |

FIG.10

| | | | | | |
|---|---|---|---|---|---|
| X(DON'T CARE) | DOM + 50h | MI7b5 + 60h | SUS + 0h | DOM + 30h | MI7 + 90h |
| MI7 + 20h | DIM + 00h | MAJ + 00h | MIN + 50h | DIM + 00h | DOM + 00h |
| DOM + 20h | MIN + 00h | AUG + 00h | MAJ + 50h | MI7b5 + 00h | MAJ 7 + 0h |
| SUS + 70h | MAJ + 80h | MIN + 90h | SUS + 50h | X | MAJ + 00h |
| MI7b5 + 20h | DIM + 0h | DOM + 00h | X | AUG + 00h | X |
| DOM + 20h | MI7 + 00h | MAJ7 + 00h | MAJ + 50h | MI7b5 + 90h | X |

FIG.11

| | | | | |
|---|---|---|---|---|
| X (DON'T CARE)<br>X<br>X<br>X<br>X | X<br>X<br>X<br>X<br>X | X<br>X<br>X<br>MAJ7+80h<br>X | X<br>X<br>X<br>X<br>X | X<br>X<br>X<br>X<br>X |
| X<br>X<br>X<br>X<br>X | X<br>X<br>DOM7SUS+70h<br>X<br>DOM7SUS+20h | X<br>X<br>DOM+80h<br>M17b5+90h<br>X | X<br>X<br>MI7+90h<br>X<br>X | X<br>X<br>X<br>X<br>X |
| X<br>X<br>X<br>MAJ7+10h<br>X | X<br>X<br>MI7b5+20h<br>DOM+20h<br>X | X<br>M17+50h<br>X<br>M17+00h<br>X | X<br>MI7b5+60h<br>DOM+00h<br>X<br>X | X<br>DOM7SUS<br>X<br>X<br>X |
| X<br>X<br>X<br>X<br>X | X<br>X<br>MI7+20h<br>X<br>X | X<br>DOM+50h<br>MI7b5+0h<br>X<br>X | MAJ7+50h<br>X<br>MAJ7+00h<br>X<br>X | X<br>X<br>X<br>X<br>X |
| X<br>X<br>X<br>X<br>X | X<br>X<br>X<br>X<br>X | X<br>DOM7SUS+50h<br>X<br>X<br>X | X<br>X<br>X<br>X<br>X | X<br>X<br>X<br>X<br>X |

FIG.12

ADAPTIVE CHORD GENERATING APPARATUS AND THE METHOD THEREOF

BACKGROUND OF THE INVENTION

The present invention relates to a function for generating a chord according to a key operation of a performer in an electronic musical instrument, and more particularly to an apparatus and method for exactly generating a chord corresponding to a key operated by the performer.

A general electronic musical instrument is a device for generating musical instrument sound corresponding to a melody played by a performer and comprises a keyboard means for receiving a melody specified by a performer and a sound source processing means for generating musical instrument sound according to key data supplied from the keyboard means. And, the electronic musical instrument additionally has auxiliary functions to automatically play a rhythm (drum sound) and a bass chord as well as the melody playing function so as to improve the performance effect and provide the performer with a convenient means of performing.

However, during the chord-playing mode, an electronic musical instrument generates the chord specified by the performer only when the performer inputs three or more constituent notes of the inputted chord, and converts the currently outputted chord into another chord only when two or more of the constituent notes of the inputted chord are different from those of the currently outputted chord. Accordingly, the conventional electronic musical instrument has problems in that the chord specified by the performer is not generated or a chord being different from the chord specified by the performer is generated. Such a problem is described with reference to the attached drawings as follows.

With reference to FIG, a conventional electronic musical instrument comprising a keyboard 10 for receiving constituent notes of a chord and a melody specified by a user, and a microcomputer 16 for receiving key data from the keyboard 10 is described. According to logic values of a rhythm selection signal supplied from a rhythm (drum sound) selection switch 12 and a bass selection signal supplied from a bass selection switch 14, the microcomputer 16 generates rhythm data, and melody sound data and chord data, both of which are processed from the key data supplied from the keyboard 10. In detail, when only the rhythm selection signal is in a high logic state, i.e., when the rhythm selection switch 12 is turned on, the microcomputer 16 assigns all keys of the keyboard 10 as a melody input portion, and generates melody sound data and rhythm data corresponding to the key data supplied from the keyboard 10. And, when only the bass selection signal is in a high logic state, i.e., when only the bass selection switch 14 is turned on, the microcomputer 16 assigns a part of the keys of the keyboard 10 as a melody input portion, and the other keys as a chord input portion, and generates chord data and melody data corresponding to key data supplied from the melody input portion and chord input portion, with rhythm data. Also, when both the rhythm selection signal and the bass selection signal are in low logic state, i.e., when both the rhythm selection switch 12 and the bass selection switch 14 are turned off, the microcomputer 16 assigns all keys of the keyboard 10 as a melody input portion, and generates melody data corresponding to key data supplied from the keyboard 10. To generate the chord data, the microcomputer 16 stores within its nonvolatile memory a chord table having chord type and a plurality of constituent-note key data according to a keynote of the chord type (i.e., according to a chord), and searches from the chord table the chord type and keynote having the same plural constituent-note key data as the three or more key data inputted from the chord input portion of the keyboard 10, thereby generating the performer-specified chord data by the searched chord type and keynote. Also, the microcomputer 16 does not generate chord data when two or less key data are received from the chord input portion of the keyboard 10, and does not change the previously generated chord data when three or more key data are received from the chord input portion and are not different in two or more keys from the previously inputted three or more key data.

The conventional electronic musical instrument additionally comprises a sound source circuit 18 for receiving melody data, rhythm data and chord data from the microcomputer 16. The sound source circuit 18 generates a rhythm signal having drum timbre by the rhythm data, and generates a musical instrument sound signal of predetermined timbre having predetermined pitch of note according to the melody data and chord data. The musical instrument sound signal and rhythm signal are filtered in a filter 20, so as to remove their unnecessary noise components. The filtered musical instrument sound signal and rhythm signal are amplified by a predetermined amplification rate in an amplifier 22 to sufficiently drive a speaker 24.

As described above, the conventional chord generating method does not generate a chord when a performer inputs two or less constituent notes of a chord, and does not change the chord when the currently input three or more constituent notes of chord are not different in two or more from the previously inputted constituent notes of a chord, thereby creating a problem in generating a chord different from that desired by the performer. And, the conventional chord-generating apparatus has a problem in that excessive memory capacity is needed to store the chord table composed of chord types and a plurality of constituent-note key data specified by the keynote, i.e., by chord names.

SUMMARY OF THE INVENTION

It is an object of the present invention to provide an adaptive chord-generating apparatus and method for exactly generating a chord specified by a performer.

To achieve the object, the adaptive chord generating apparatus of the present invention comprises:

- a keyboard for receiving constituent notes of a chord, and a melody;
- a memory where a chord search table is stored;
- a control portion for searching a chord search table of the memory by a rule corresponding to the number of constituent notes inputted from the keyboard and generating chord data based on the searched data; and
- a sound source generating means for generating a musical instrument sound signal having a predetermined pitch of chord corresponding to chord data supplied from the control portion.

To achieve the object, the present method of generating an adaptive chord comprises the steps of:

- receiving constituent notes of a chord through a keyboard;
- checking the number of the inputted constituent notes;
- searching a chord type and a pitch parameter from a chord search table stored in a memory by a constant rule when the number of constituent notes is two or more; and yielding a pitch of chord based on the searched pitch of chord and the inputted constituent notes and then producing chord data having a chord type and a pitch of chord.

BRIEF DESCRIPTION OF THE DRAWINGS

The above object and other advantages of the present invention will become more apparent by describing the preferred embodiment of the present invention with reference to the attached drawings, in which;

FIG. 9 is a table explaining a chord type and a chord type weight generated by a chord-generating method and apparatus of an embodiment of the present invention;

FIG. 10 is a chord search table for two chord constituent-note keys to be used in a chord-generating method of an embodiment of the present invention;

FIG. 11 is a chord search table for three chord constituent-note keys to be used in a chord-generating method of an embodiment of the present invention; and FIG. 12 is a chord search table for four chord constituent-note keys to be used in a chord-generating method of an embodiment of the present invention.

DETAILED DESCRIPTION OF THE INVENTION

Figure 2:
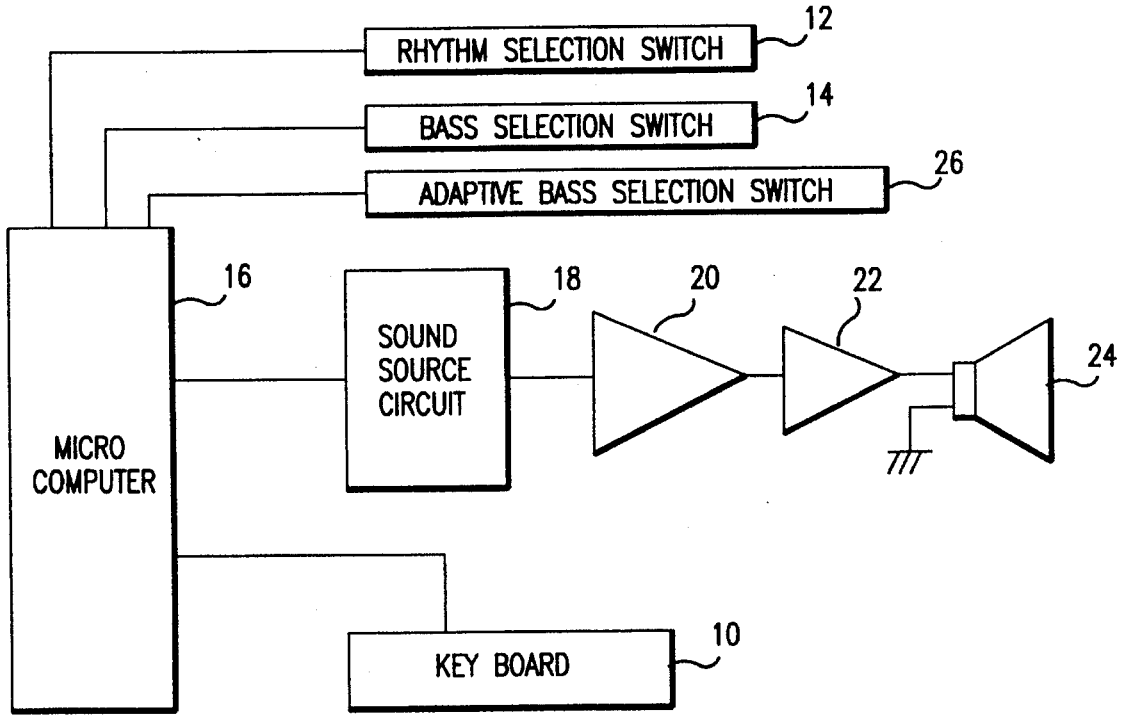
FIG. 2 is a block diagram of an electronic musical instrument where an adaptive chord-generating apparatus according to the present invention is applied.

FIG. 2 describes an electronic musical instrument according to an embodiment of the present invention, which comprises a keyboard 10 for receiving constituent notes of a chord, and a melody, and a microcomputer 16 for receiving key data from the keyboard 10. The microcomputer 16 receives a rhythm selection signal from a rhythm selection switch 12, a bass selection signal from a bass selection switch 14, and an adaptive bass selection signal from an adaptive bass selection switch 26. The rhythm selection signal has a high logic state when a rhythm generating mode is specified, i.e., when the rhythm selection switch 12 is turned on. The bass selection signal has a high logic state when a chord-generating mode for generating a chord according to constituent notes inputted by a user is specified, i.e., when the bass selection switch 14 is turned on. The adaptive bass selection signal has a high logic state when an adaptive bass generating mode for adaptively processing the inputted constituent notes according to the number of the constituent notes inputted by the user and generating a chord corresponding to the inputted constituent notes is specified, i.e., when the adaptive bass selection switch 26 is turned on. The microcomputer 16 generates melody data, rhythm data and chord data according to logic values of the adaptive bass selection signal, the rhythm selection signal and the bass selection signal. In other words, when all of the rhythm selection, bass selection and adaptive bass selection signals are in low logic states, the microcomputer 16 assigns all keys of the keyboard 10 as a melody input portion, and generates melody data having the pitch of note corresponding to a logic value of key data supplied from the keyboard 10. And, when only the rhythm selection signal, among the three selection signals, has a high logic state, the microcomputer 16 assigns all keys of the keyboard 10 as a melody input portion, and generates extra rhythm data with melody data corresponding to key data supplied from the keyboard 10. Also, when the rhythm selection signal and the bass selection signal, among the three selection signals, have high logic states, the microcomputer 16 assigns part of the keys (the keys from the right end to the center) of the keyboard 10 as a melody input portion, and the other keys (the keys from the center to the left end) of the keyboard 10 as a chord input portion, and generates rhythm data with melody data corresponding to key data supplied from the melody input portion, and chord data of the chord specified by three or more constituent-note key data supplied from the chord input portion.

Finally, when all of the three selection signals are in a high logic state, the microcomputer 16 assigns part of the keys of the keyboard 10 as a melody input portion and the other keys of the keyboard 10 as a chord input portion, and generates rhythm data with melody data corresponding to key data supplied from the melody input portion, and also adaptively processes the constituent-note key data supplied from the chord input portion according to its number, to generate chord data having a pitch of chord corresponding to the inputted constituent-note key data. Also, when rhythm data is generated, the microcomputer 16 receives a rhythm information selection signal and a performer discrimination signal from a rhythm information selection means (not shown) for receiving the rhythm type and meter and a performer discrimination switch (not shown) for receiving whether the performer is a beginner or an expert. To generate the rhythm and chord, the microcomputer 16 comprises a memory where a rhythm table and a chord search table are stored. The memory is installed within the microcomputer or in an external memory connected to the microcomputer.

The electronic musical instrument additionally comprises a sound source circuit 18 for receiving melody data, chord data and rhythm data from the microcomputer 16. The sound source circuit 18 generates a musical instrument sound signal of predetermined timbre including a melody signal having a pitch corresponding to the melody data and a chord signal having a pitch corresponding to the chord data. And, the sound source circuit 18 generates a rhythm signal having drum timbre corresponding to the rhythm data. The unnecessary noise signals of the musical instrument sound signal and rhythm signal are filtered in a filter 20. The filtered musical instrument sound signal and rhythm signal are amplified by an amplifier 22 to sufficiently drive a speaker 24.

Figure 3A:
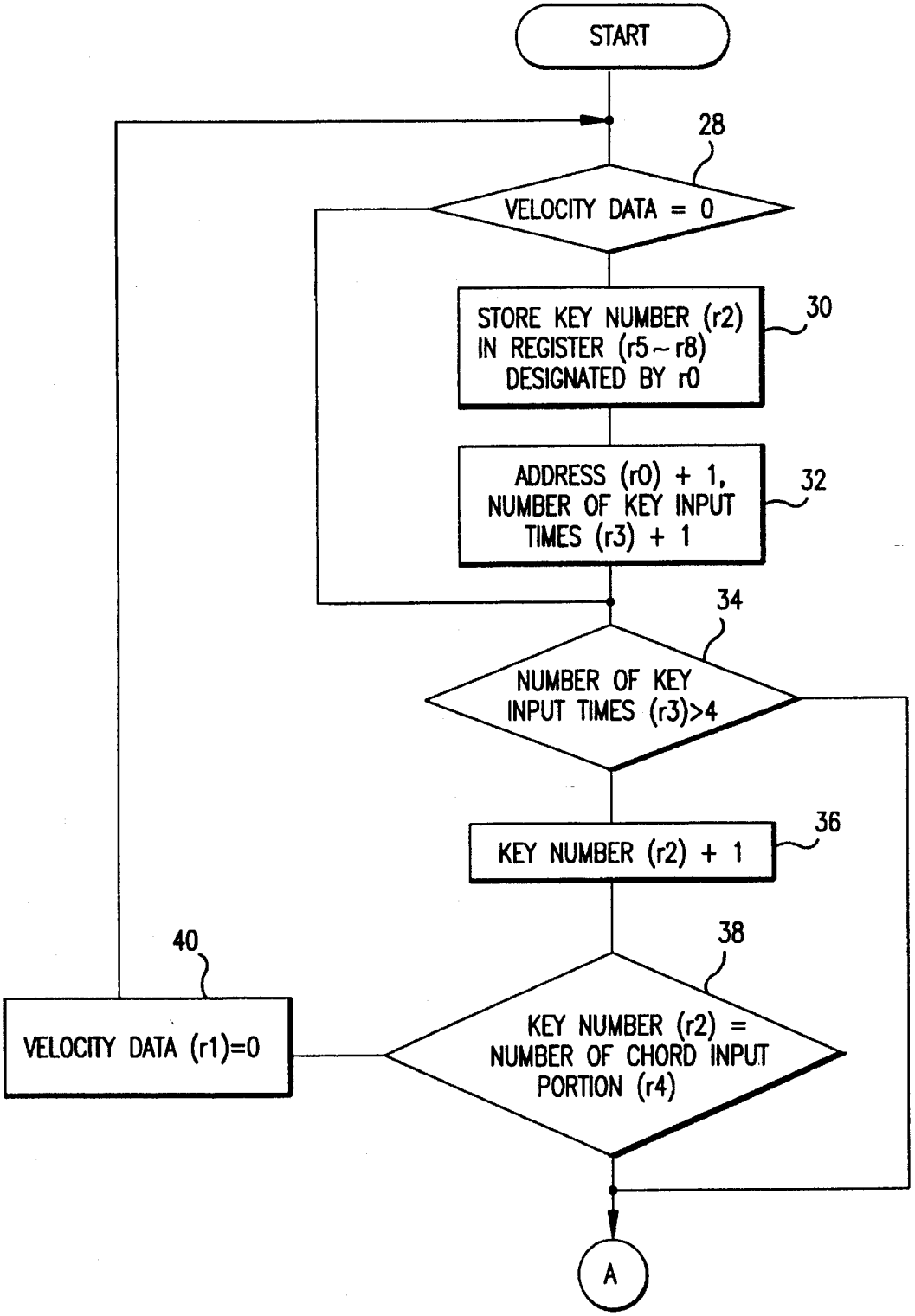
FIGS. 3A and B are flow chart of a chord-generating method according to an embodiment of the present invention.
Figure 3B:
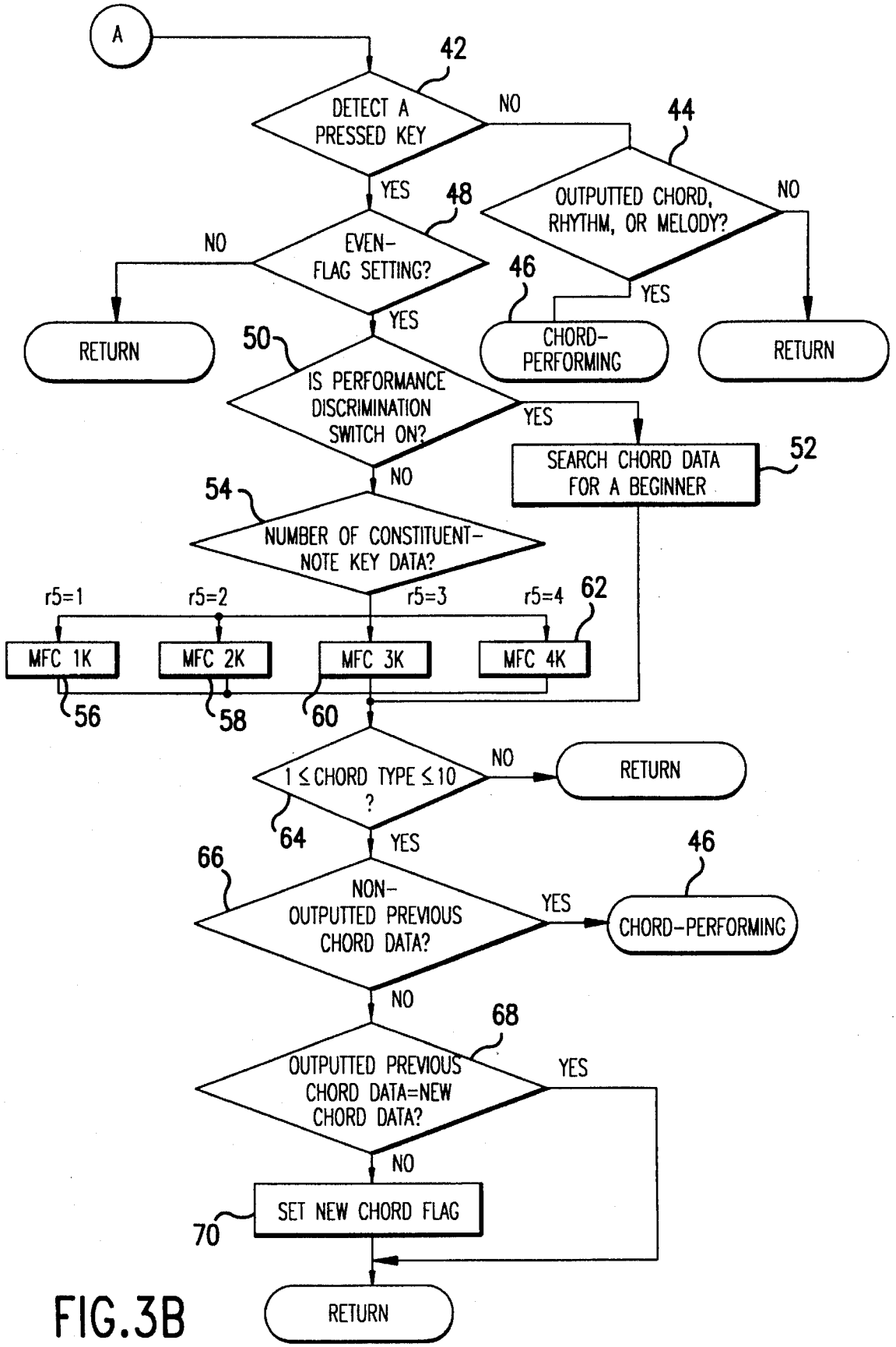

In FIGS. 3A and 3B, flow charts according to an embodiment of the present adaptive chord-generating method performed by the microcomputer 16 shown in FIG. 2 is described. In FIG. 3, steps 28 to 40 are a process for periodically scanning keys of a chord input portion of the keyboard 10 to detect the key pressed by a performer.

Before describing FIGS. 3A and 3B, it should be mentioned that the microcomputer comprises working memory and counting memory elements for processing data within itself, and to simplify description of these memories, they are represented as registers identified by the respective numerals r0 to r10.

In step 28, the microcomputer 16 checks whether a logic value of velocity data stored in its register r1 is "0", to determine whether the currently scanned key is pressed.

When the logic value of the velocity data is not "0" in step 28, the microcomputer 16 stores a currently scanned key number counted in a register r2 in registers r5 to r8 having an address corresponding to a logic value of the address stored in its register r0 (in step 30).

After step 30, the microcomputer 16 adds 1 to the number of key input occurrences counted in a register r3, to count the number of currently inputted keys (in step 32).

When the velocity data is "0" in step 28, or after performing step 32, the microcomputer 16 checks whether the number of key input occurrences counted in the register r3 is greater than 4, thereby determining whether four or more constituent-note key data are inputted (in step 34).

When the number of key input occurrences is less than or equal to four in step 34, the microcomputer 16 adds 1 to the key number counted in the register r2 (in step 36).

After performing step 36, the microcomputer 16 checks whether the key number counted in the register r2 is the same as the number of keys of chord input portion stored in the register r4, to determine whether all keys of chord input portion are scanned (in step 38).

When the key number counted in the register r2 is smaller than the number of keys stored in the register r4 in step 38, the microcomputer 16 initializes the velocity data stored in the register r1 to "0" and then performs step 28 (in step 40).

As a result, the microcomputer 16 performs step 28 to 40, thereby receiving up to four constituent-note data inputted by a performer from the chord input portion of the keyboard 10. And, the microcomputer 16 performs steps 42 to 52 to determine an adaptive chord-generating mode of inputted constituent-note key data and a beginner performing mode.

When the number of key input occurrences counted in the register r2 is greater than four in step 34 or when the number of keys of chord input portion of keyboard 10 stored in the register r4 is equal to the key number counted in the register r2, the microcomputer 16 checks whether the number of key input occurrences counted in the register r3 is greater than "0", to determine whether there is a key pressed by a performer (in step 42).

When the number of key input occurrences counted in the register r3 is "0" in step 42, the microcomputer 16 checks whether there are chord, rhythm or melody data to be outputted to the sound source circuit 18 (in step 44).

When there are currently outputted chord, rhythm or melody data in step 44, the microcomputer 16 supplies the outputted chord, rhythm and melody data to the sound source circuit 18, to perform a chord-performing stage (in step 46). At this time, the sound source circuit 18 generates a musical instrument sound signal and a rhythm signal having pitch and timbre corresponding to the data supplied from the microcomputer 16 and outputs the generated signals through a filter 20, an amplifier 22 and a speaker 24.

On the other hand, when the number of key input occurrences counted in the register r3 is not "0+ in step 42, the microcomputer 16 checks whether its event flag is set, to determine whether it is in an adaptive chord-generating mode (in step 48). The event flag is set to 1 when all of the rhythm, bass and adaptive bass selection switches 12, 13 and 26 are turned on.

When the event flag is not set in step 48 (i.e., in an adaptive-chord generating mode), the microcomputer 16 checks whether the performer discrimination switch is turned on, to determine whether the current performer is a beginner (in step 50).

When the performer discrimination switch is turned on in step 50 (i.e., when the current performer is a beginner), the microcomputer 16 searches chord data having pitch of chord and chord type corresponding to the inputted constituent-note key data by a conventional method for generating chord data only by a keynote of chord (in step 52).

On the other hand, when the performer discrimination switch is turned off in step 50 (i.e., when the current performer is an expert), the microcomputer 16 checks the number of key input occurrences counted in the register r3 to determine how many constituent-note key data are inputted (in step 54).

And, the microcomputer 16 performs one of steps 56 to 62 according to the determined result. In step 56, the microcomputer 16 generates chord data including pitch of chord and chord type by the constituent-note key data stored in the register r5. In step 58, the microcomputer 16 generates chord data by two constituent-note key data stored in two registers r5 and r6. Also, in step 60, the microcomputer 16 generates chord data by three constituent-note key data stored in three registers r5 to r7. Finally, in step 62, the microcomputer 16 generates chord data by four constituent-note key data stored in four registers r5 to r8.

After performing one of step 52, 56, 58, 60 or 62, the microcomputer 16 checks whether a logic value of chord type of generated chord data is a value between 1 and 10, to determine whether the chord type is one of ten chord types shown in FIG. 9 (in step 64).

When the logic value of chord type of the chord data has a value between 1 and 10 in step 64 (i.e., when it corresponds to one of ten chord types shown in FIG. 9), the microcomputer 16 checks whether there is previous chord data which has not been outputted (in step 66). At this time, when there is non-outputted previous chord data, the microcomputer 16 performs step 46.

On the other hand, when there is no non-outputted previous chord data in step 66, the microcomputer 16 checks whether the new chord data is equal to the previously generated chord data (in step 68).

When the new chord data is not equal to the previous chord data in step 68, the microcomputer 16 sets another chord flag showing that new chord data will be outputted, instead of the chord flag showing that the previous chord data will be outputted, thereby outputting new chord data to the sound source circuit 18 (in step 70).

Figure 4:
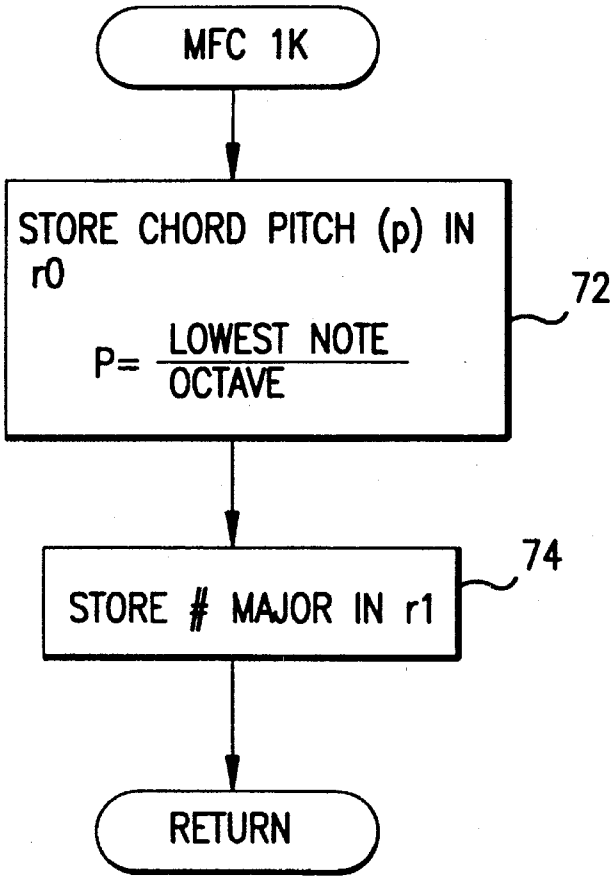
FIG. 4 is a sub-flow chart explaining a step of processing a chord by one chord constituent-note key, shown in FIG. 3.

FIG. 4 shows a sub-flow chart explaining a step 56 of producing chord data by one chord constituent-note key data shown in FIG. 3B. In step 72 shown in FIG. 4, the microcomputer 16 divides the logic value of constituent-note key data stored in the register r5 by the number of keys (i.e., 12) included in one octave and produces the divided value as a pitch of chord and stores the produced pitch of chord in a register r0. After performing step 72, the microcomputer 16 sets the major having a keynote corresponding to constituent-note key data stored in the register r5 as a chord type, and stores the set chord type in the register r1, and then returns to step 64 (in step 74).

Figure 5:
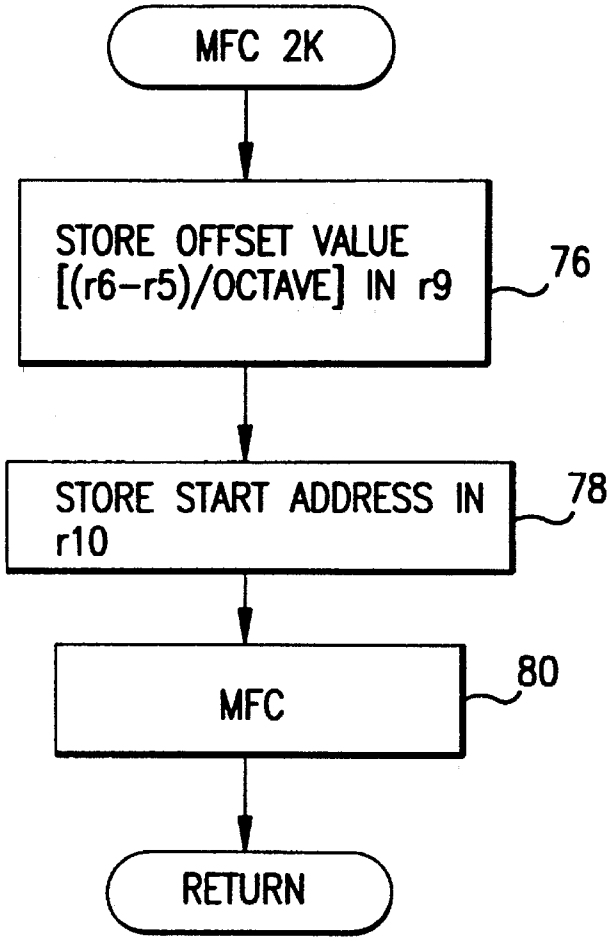
FIG. 5 is a sub-flow chart explaining a step of processing a chord by two chord constituent-note keys, shown in FIG. 3.

In FIG. 5, a step 58 of producing chord data by two constituent-note key data, as shown in FIG. 3 is described in detail. In step 76 shown in FIG. 5, the microcomputer 16 subtracts a logic value of the first inputted constituent-note key data stored in the register r5 from a logic value of the second inputted constituent-key data stored in the register r6, and divides the subtracted value by the number of keys (i.e., 12) included in an octave, thereby producing an offset value, and then stores the produced offset value in a register r9. The microcomputer 16 stores in a register r10 a start address of storage region of memory where a first chord search table shown in FIG. 10 is stored (in step 78). After performing step 78, the microcomputer 16 determines a pitch of chord and a chord type by the values stored in the two registers r9 and r10 (in step 80).

Figure 6:
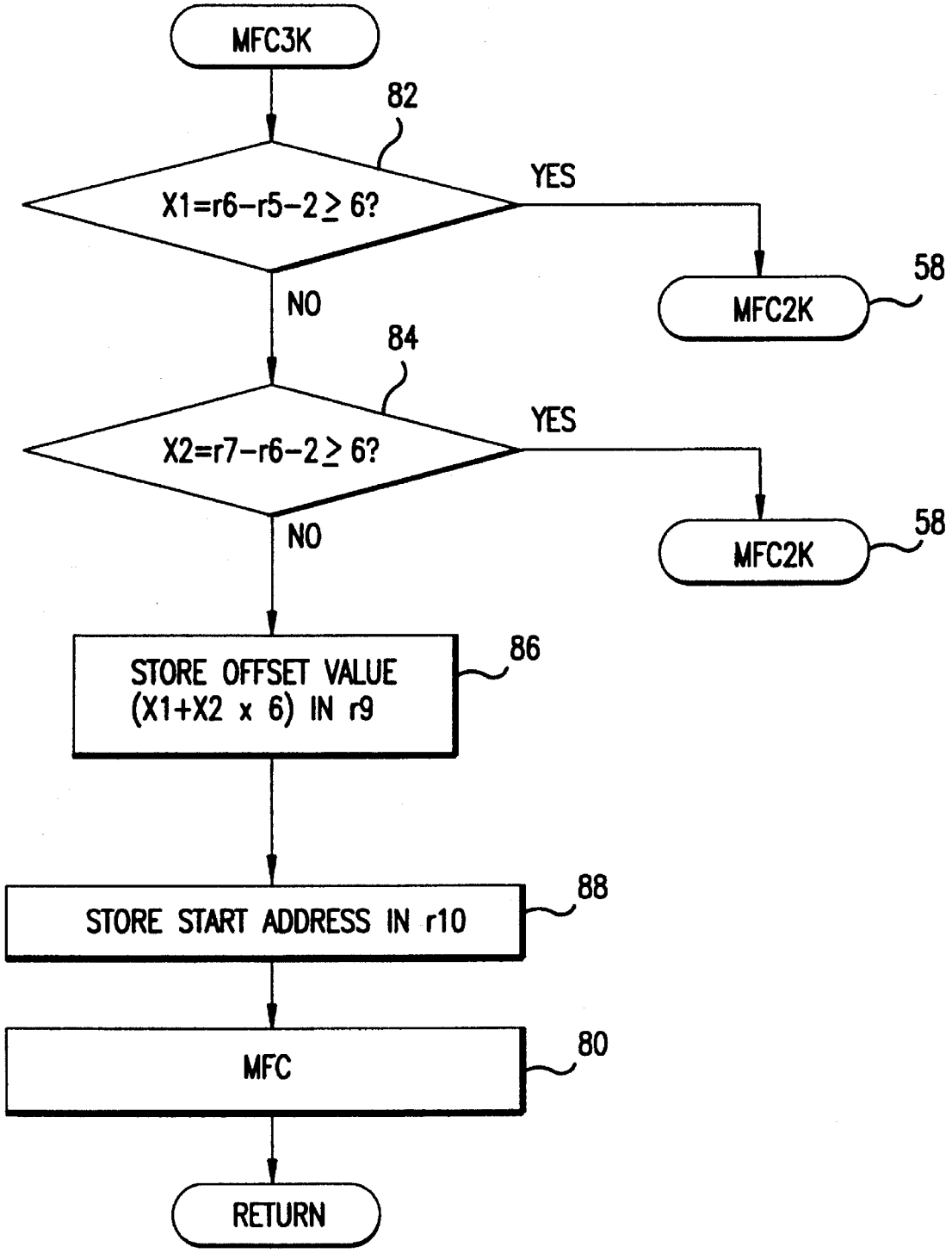
FIG. 6 is a sub-flow chart explaining a step of processing a chord by three chord constituent-note keys, shown in FIG. 3.

FIG. 6 shows a sub-flow chart of the step 60, shown in FIG. 3B, of producing chord data by three constituent-note key data. In step 82 of FIG. 6, the microcomputer 16 subtracts a logic value of constituent-note key data stored in the register r5 (i.e., the first inputted key data) and a predetermined coefficient (i.e., 2) from the constituent-note key data stored in the register r6 (i.e., the second inputted key data), and checks whether the subtracted value X1 is greater than or equal to 6, to determine whether the constituent-note keys of the values stored in the registers r5 and r6 are separated by 4 keys or more (in step 82). When the subtracted value X1 is smaller than 6 in step 82, the microcomputer 16 subtracts a logic value of constituent-note key data stored in the register r6 (i.e. the second inputted key data) and a predetermined coefficient (i.e., 2) from a logic value of constituent-note key data stored in the register r7 (i.e., the third inputted key data), and checks whether the subtracted value X2 is greater than or smaller than 6, to determine whether the constituent-note keys of the values stored in the registers r7 and r8 are separated by four or more keys (in step 84). When the subtracted value X2 is smaller than 6, the microcomputer 16 multiplies the subtracted value X2 produced in step 84 by a second predetermined coefficient (i.e., 6) and adds the multiplied value to the subtracted value X1 produced in step 82, thereby producing an offset value. And, the produced offset value is stored in the register r9 (in step 86). After performing step 86, the microcomputer 16 stores in a register r10 a start address of storage region of memory where a second chord search table shown in FIG. 11 is stored (in step 88). After performing step 88, the microcomputer 16 produces a pitch of chord and a chord type by the values stored in the registers r9 and r10 (in step 80). Also, when the subtracted value X1 is greater than or equal to 6 in step 82, or the subtracted value X2 is greater than or equal to 6 in step 84, the microcomputer 16 behaves as if two constituent-note key data are inputted and returns to step 58 shown in FIG. 3, in more detail, to step 76 shown in FIG. 5.

Figure 1:
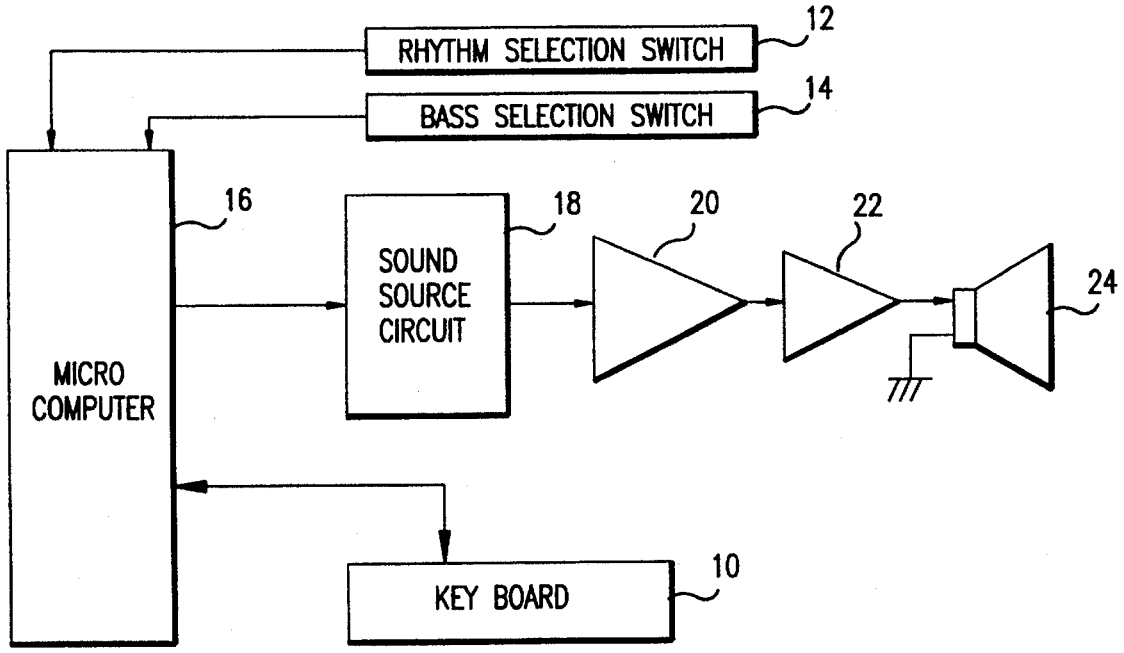
FIG. 1 is a block diagram of a conventional electronic musical instrument.
Figure 7:
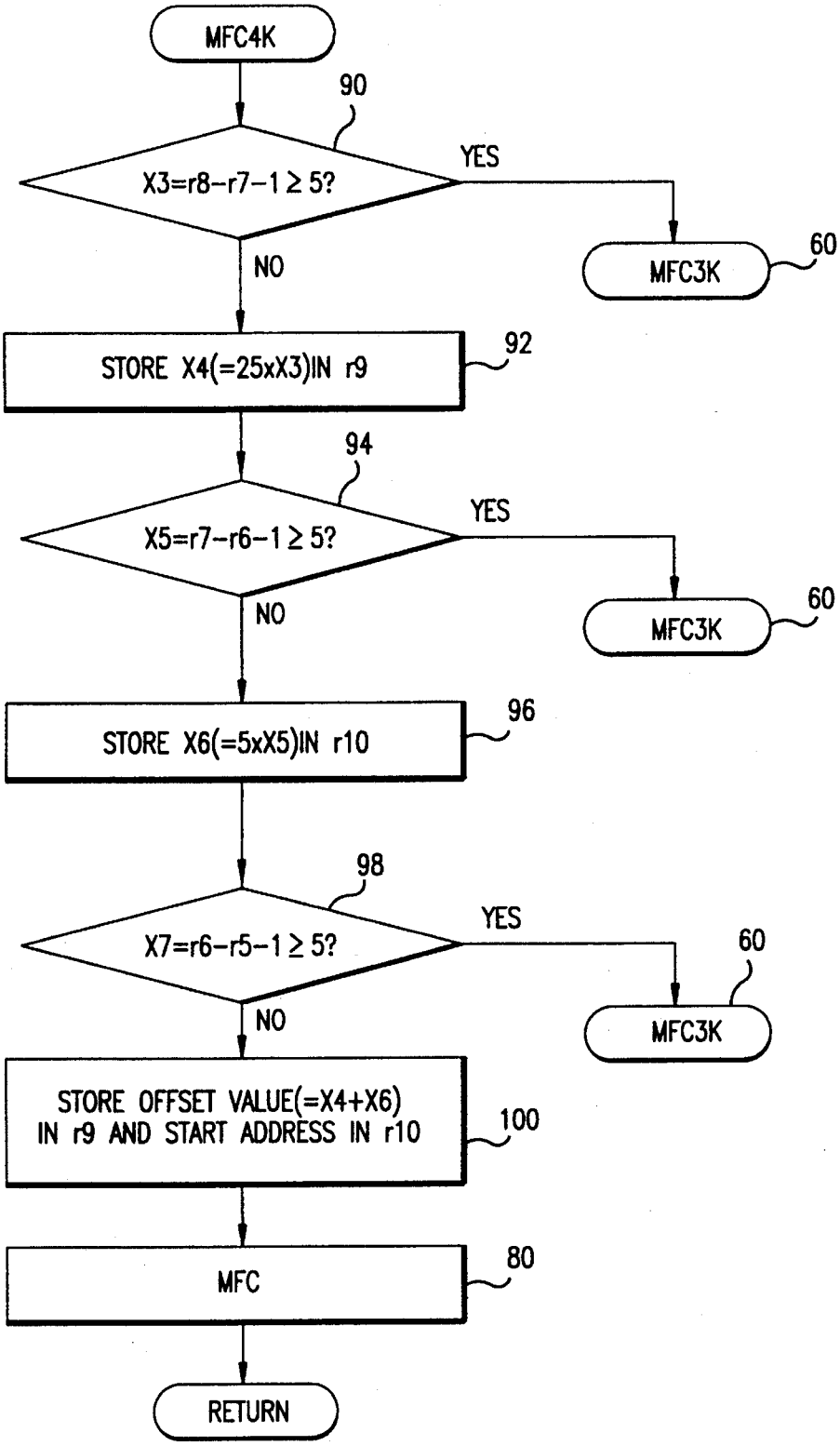
FIG. 7 is a sub-flow chart explaining a step of processing a chord by four chord constituent-note keys, shown in FIG. 3.

FIG. 7 shows a sub-flow chart of step 62, shown in FIG. 3B, of producing chord data by four constituent-note key data. In step 90 of FIG. 7, the microcomputer 16 subtracts a logic value of constituent-note key data stored in the register r7 (i.e., the third inputted key data) and a third predetermined coefficient (i.e., 1) from constituent-note key data stored in the register r8 (i.e., the fourth inputted key data) and checks whether the subtracted value X3 is greater than or equal to 5. When the subtracted value X3 is smaller than 5 in step 90, the microcomputer 16 multiplies the subtracted value X3 by a fourth predetermined coefficient (i.e., 25), and stores the multiplied value X4 in the register r9 (in step 92). After performing step 92, the microcomputer 16 subtracts a logic value of constituent-note key data stored in the register r6 (i.e., the second inputted key data) and a third predetermined coefficient (i.e., 1) from constituent-note key data stored in the register r7 (i.e., the third inputted key data), and checks whether the subtracted value X5 is greater than or equal to 5 (in step 94). When the subtracted value X5 is smaller than 5 in step 94, the microcomputer 16 multiplies the subtracted value X5 by a fifth predetermined coefficient (i.e., 5), and stores the multiplied value X6 in a register r10 (in step 96). After performing step 96, the microcomputer 16 subtracts a logic value of constituent-note key data stored in the register r5 (i.e., the first inputted key data) and the third predetermined coefficient (i.e., 1) from constituent-note key data stored in the register r6 (i.e., the second inputted key data) and checks whether the subtracted value X7 is greater than or smaller than 5 (in step 98). When the subtracted value X7 is smaller than 5 in step 98, the microcomputer 16 adds the multiplied value X4 generated in step 92 to the multiplied value X6 produced in step 96, thereby storing the generated offset value in the register r9 and stores in the register r10 a start address of storage region of memory where a third chord search table shown in FIG. 12 is stored (in step 100). After performing step 100, the microcomputer 16 produces a pitch of chord and a chord type by the values stored in the registers r9 and r10 (in step 80). Also, when the subtracted value X3 is greater than or equal to 5 in step 90, when the subtracted value X5 is greater than or equal to 5 in step 94, or when the subtracted value X7 is greater than or equal to 5 in step 96, the microcomputer 16 behaves as if three constituent-note key data are inputted, and performs step 60 shown in FIG. 1, in more detail, to step 82 shown in FIG. 6.

Figure 8:
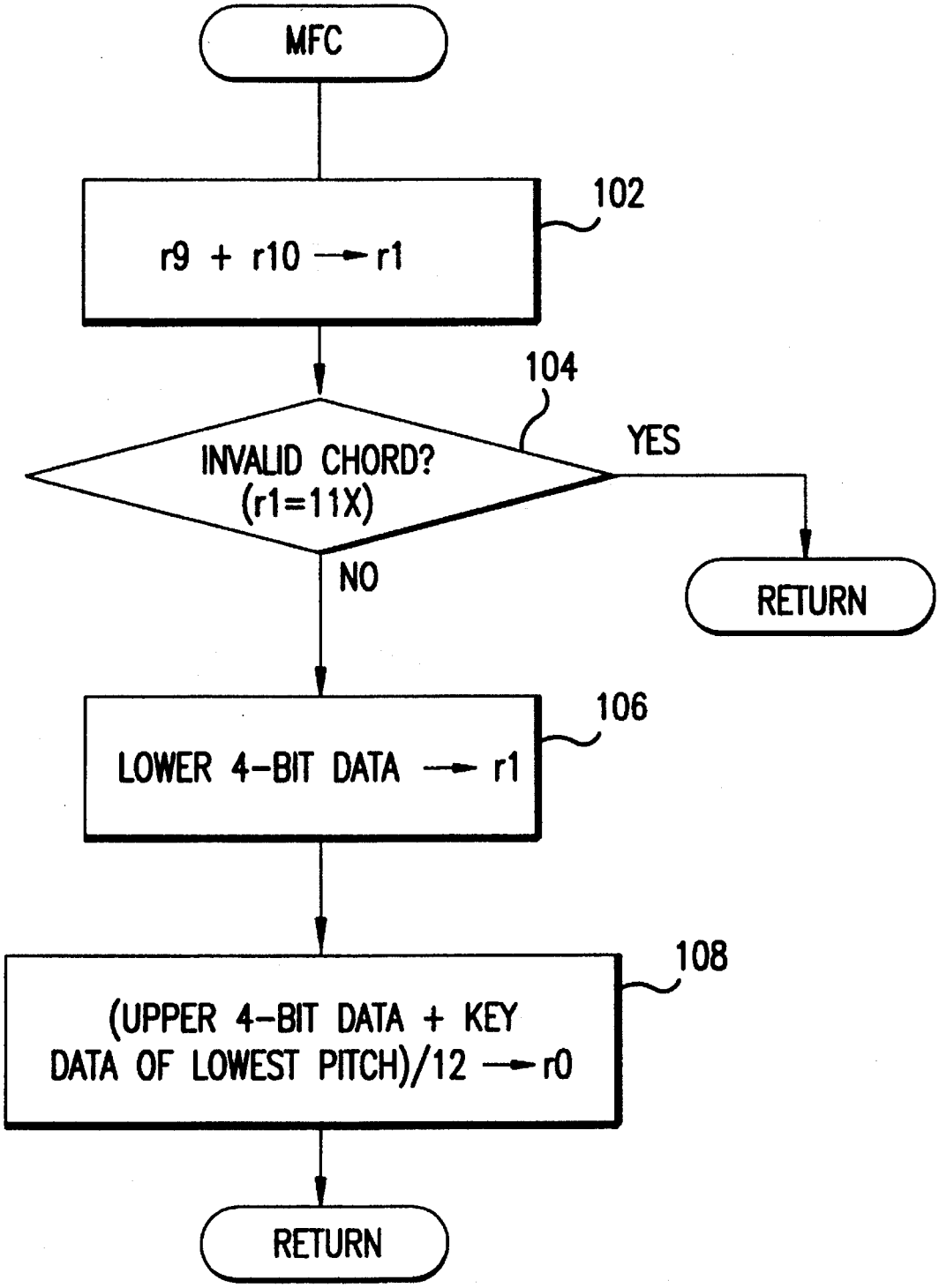
FIG. 8 is a sub-flow chart explaining a step of determining a pitch of chord and a chord type, shown in FIGS. 5 to 7.

With reference to FIG. 8, the step 80, shown in FIGS. 5 to 7, of producing the pitch of chord and the chord type is described in detail. In step 102 of FIG. 8, the microcomputer 16 adds an offset value stored in the register r9 to a start address of chord search table stored in the register r10 (i.e., a start address of first chord search table shown in FIG. 10, that of second chord search table shown in FIG. 11, or that of third chord search table shown in FIG. 12), and reads out a chord type weight and pitch parameter stored in the added address value from a memory, and stores them in the register r1. After performing step 102, the microcomputer 16 checks whether the chord type weight and pitch parameter read out from the memory are a predetermined value 11X, to determine whether they are invalid chord type weight and pitch parameter (in step 104). When the chord type weight and pitch parameter are not the predetermined value 1X in step 104, i.e., when the chord type weight and pitch parameter are valid, the microcomputer 16 stores the chord type weight and pitch parameter as upper significant four-bit chord types in the register r1 (in step 106). After performing step 106, the microcomputer 16 adds the lower significant 4-bit pitch parameter between the chord type weight and pitch parameter to constituent-note key data having the lowest pitch (i.e., the leftmost key number in the keyboard 10) among the constituent-note key data stored in the registers r5 to r8 and divides the added value X8 by the number of keys (i.e., 12) included in an octave, thereby producing pitch of chord. The produced pitch of chord is stored in a register r0 (in step 108).

With reference to FIG. 9, a chord type table having ten chord types is described. In the chord type table, weight values 1 to 10 given by chord types, and characteristic labels for the respective chord types are written.

FIG. 10 describes a first chord search table used to produce chord data by two constituent notes. In the first chord search table, data, each of which is composed of a label and a weight value indicating a chord type, and a pitch parameter used to produce pitch of chord are arranged by a constant rule. The data of the first chord search table are stored in an assigned storage region of nonvolatile memory by a manufacturer.

A second chord search table shown in FIG. 11 and a third chord search table shown in FIG. 12 are stored in storage region of nonvolatile memory by a manufacturer, in the same way as that of first chord search table. The first to third chord search tables can be sequentially stored in a certain storage region or dispersively stored in the memory. The offset values described in FIGS. 5 to 8 show the distance of storage region of memory from a start address of first to third chord search tables to an object data position.

As described above, the present invention has an advantage in that a chord search table arranging data composed of chord type and pitch parameter by a rule is used, thereby exactly generating a chord required by a performer according to the number of constituent notes of chord inputted by a user. Also, there is another advantage in reducing the required memory capacity by storing only the data composed of chord type and pitch parameter by a rule in the memory.

What is claimed is:

1. A chord generating musical instrument comprising:

a keyboard having a plurality of pressure detecting keys corresponding in a one-to-one manner to a first plurality of musical notes;

a constituent note register for outputting a plurality of constituent musical notes, each of said output notes having a corresponding numerical value, in response to depression of a corresponding plurality from among said pressure detecting keys;

a storage means for storing a plurality of chord tables, each comprising a corresponding number of said chord data and each having a corresponding start address in said storage means for calculating chord data having a chord type field and a pitch field in accordance with the number of the input pressure detecting keys activated;

a controller comprising means for detecting the number of said constituent notes output by said constituent note register and outputting a detected number in response, means for storing a plurality of predetermined reading rules, means for selecting from among said plurality of reading rules in accordance with said detected number, means for reading a chord data from chord table in accordance with said selected reading rule and said output constituent notes, and means for outputting said read chord data, wherein said means for selecting from among said plurality of reading rules has means for selecting a first rule in response to said detected number indicating two constituent notes output by said constituent note register, and said means for reading a chord data has means for reading from said first chord table in accordance with said first rule, said two output constituent notes consisting of a first note and a second note higher than said first, wherein said means for selecting from among said plurality of reading rules has means for selecting a second rule in response to said detected number indicating three constituent notes output by said constituent note register, and said means for reading a chord data has means for reading from said second chord table in accordance with said second rule, said three output constituent notes consisting of a first note, a second note higher than said first note, and a third note higher than said second note; and wherein said means for selecting from among said plurality of reading rules has means for selecting a third rule in response to said detected number indicating four or more constituent notes output by said constituent note register, and said means for reading a chord data has means for reading from said third chord table in accordance with said third rule, said four or more output constituent notes consisting of at least a first note, a second note higher than said first note, a third note higher than said second note, and a fourth note higher than said third note; and means for generating a sound signal, in response to said output chord data, having a pitch value corresponding to said output chord data.

2. An adaptive chord-generating apparatus according to claim 1, wherein said first selection rule, in response to said detected number indicating two constituent notes output by said constituent note register, calculates a chord table location {a} and said means for reading a chord data reads a chord data associated with location {a}, where {a}={(said second note of said two constituent notes–said first note of said two constituent notes)/12+said start address of said first chord table};

said second selection rule, in response to said detected number indicating three constituent notes output by said constituent note register, calculates a location {b} and said means for reading a chord data reads a chord data associated with location {b}, where {b}={(said third note of said three constituent notes–said second of said three constituent notes– 2)+((said second note of said three constituent notes–said first note of said three constituent notes–2)×6)+said start address of said second chord table};

said third selection rule, in response to said detected number indicating four or more constituent notes output by said constituent note register, calculates a location {c} and said means for reading a chord data reads a chord data associated with location {c}, where {c}={((said fourth note of said four or more constituent notes–said third note of said four or more constituent notes–1)×25)+((said third note–said second note of said four or more constituent notes–1)×5)+(said second note of said four or more constituent notes–said first note of said four or more constituent notes–1)+said start address of said third chord tablet}.

3. An adaptive chord-generating apparatus according to claim 2, wherein said controller means includes:

means for detecting the lowest of a plurality of constituent notes output by said constituent note register;

means for generating, in response to said detected number indicating not more than one constituent note output by said constituent note register, a chord pitch data based on said one constituent note divided by 12 and a chord type data associated with a major chord; and means for generating, in response to said detected number indicating two or more constituent notes output by said constituent note register, a chord pitch data based on a pitch field of said read chord data added to said detected lowest of said constituent notes divided by 12.

4. An adaptive chord-generating apparatus according to claim 2, wherein said control means has means for comparing {d} and {e} against a predetermined threshold, where {d}={a second note of a plurality of three constituent notes output by said constituent note register–a first note of said plurality– 2)}, and {e}={a third note of said plurality –2}, and, in response to said detected number indicating a plurality of three constituent notes output by said constituent note register concurrent with said comparing means indicating said {d} and {e} being greater than said predetermined threshold, said control means calculates a location {f} and said means for reading a chord data reads a chord data corresponding to location {f}, where {f}={(said second note of said plurality of three constituent notes output by said constituent note register–said first note of said plurality)/12+said start address of said first chord table}; and said control means has means for comparing {g} and {h} against a predetermined threshold, where {g}={a fourth note of a plurality of four or more constituent notes latched by said constituent note register–a third note of said plurality– 1}, and {e}={a second note of said plurality–a first note of said plurality–1}, and, in response to said detected number indicating four or more notes output by said constituent note register concurrent with said comparing means indicating {g} and {h} as being greater than said predetermined threshold, said control means calculates a location {i} and said means for reading a chord data reads a chord data corresponding to location {i}, where {i}={(said third note of said plurality of four or more notes output by said constituent note register–said second note of said plurality–2)+((said second note–said first note of said plurality–2)×6)+said start address of said second chord table}.

5. An adaptive chord-generating method for generating chord data having a chord type field and a pitch field, comprising the steps of:

manually selecting constituent notes of a chord through a keyboard, and outputting received constituent notes represented as numerical values in response;

counting the number of said received constituent notes and outputting a constituent note number based thereon;

searching a table of chord data stored in a memory device according to a predetermined rule using said received constituent notes as input variables, wherein said chord data are arranged as a first, second, and third table of chord data within said memory, each table comprising a corresponding plurality of chord data having a corresponding first, second, and third start location within said memory, respectively; and wherein said searching step searches from one from among said first, second and third tables if said constituent note number is two, three, or four or more, respectively; and producing the chord data searched from said table.

6. An adaptive chord-generating method according to claim 5, wherein said searching step, in response to said constituent note number indicating two received constituent notes, said two received constituent notes being a first note and a second note higher than said first note, reads a chord data from said first table corresponding to location {a}, where {a}={((said second note of said two received constituent notes–said first note of said two constituent notes)/12)+said start address of said first plurality of chord data};

said searching step, in response to said counting step indicating three constituent notes, said three received constituent notes being a first note, a second note higher than said first note, and a third note higher than said second note, reads a chord data from said second table corresponding to location {b} where {b}={(said third note of said three received constituent notes–said second of said three received constituent notes–2)+((said second note of said three received constituent notes–said first note of said three received constituent notes–2)×6)+said start address of said second plurality};

said searching step, in response to said counting step indicating four or more received constituent notes, said four or more received constituent notes comprising at least a first note, a second note higher than said first note, a third note higher than said second note, and a fourth note higher then said third note, reads a chord data from said third table corresponding to location {c}, where {c}={((said fourth note of said four or more received constituent notes–said third note of said four or more received constituent notes–1)×25)+((said third note of said four or more received constituent notes–said second note of said four or more received constituent notes–1)×5)+(said second note of said four or more received constituent notes– said first note of said received four or more constituent notes– 1)+said start address of said third plurality}.

7. An adaptive chord-generating method according to claim 6 wherein said chord data producing step comprises a step of detecting the lowest of said received constituent notes and a step of adding said lowest note to a pitch field of a chord data read out by said searching step, a step of dividing said added data by 12, and a step of outputting the dividend as an output pitch data.

8. An adaptive chord-generating method according to claim 7, further comprising a second chord data producing step for producing, in response to a constituent note number of one, a pitch field of the output pitch data by dividing the received constituent note by 12 and for producing a chord type field corresponding to major chord type.

* * * * *